US006478610B1

(12) United States Patent
Zhou et al.

(10) Patent No.: US 6,478,610 B1
(45) Date of Patent: Nov. 12, 2002

(54) ELECTRICAL CONNECTOR ASSEMBLY

(75) Inventors: Hong-Bin Zhou; Qi-Sheng Zheng, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/996,872

(22) Filed: Nov. 27, 2001

(30) Foreign Application Priority Data

Nov. 15, 2001 (TW) ..... 90219621

(51) Int. Cl.[7] ..... H01R 3/00
(52) U.S. Cl. ..... 439/490; 439/541.5; 439/676
(58) Field of Search ..... 439/490, 541.5, 439/676, 488

(56) References Cited

U.S. PATENT DOCUMENTS 4,978,317 A * 12/1990 Pocrass ..... 439/490
5,797,770 A * 8/1998 Davis et al. ..... 439/607
5,876,240 A * 3/1999 Derstine et al. ..... 439/490
6,120,321 A * 9/2000 Wu ..... 439/541.5
6,159,039 A * 12/2000 Wu ..... 439/541.5
6,162,089 A * 12/2000 Costello et al. ..... 439/541.5
6,183,292 B1 * 2/2001 Chen et al. ..... 439/541.5
6,227,911 B1 * 5/2001 Boutros et al. ..... 439/490
6,283,786 B1 * 9/2001 Margulis et al. ..... 439/490
6,319,051 B1 * 11/2001 Chang et al. ..... 439/490

* cited by examiner

*Primary Examiner*—Gary F. Paumen
(74) *Attorney, Agent, or Firm*—Wei Te Chung

(57) ABSTRACT

An electrical connector assembly (10) comprises a main dielectric housing (1) defining a first cavity (14) and a second cavity (13) separated from the first cavity, a first shielded connector (5) inserted into the first cavity, and a modular jack connector (20) inserted into the second cavity. The modular jack connector has a dielectric body (4), a terminal module (42) retained in the dielectric body, a pair of LEDs (3) fitted with the dielectric body, and a single retainer (2) covered onto the LEDs to secure the LEDs in position.

1 Claim, 9 Drawing Sheets

2

ELECTRICAL CONNECTOR ASSEMBLY

BACKGROUND OF THE INVENTION

1. Field of the Invention

The present invention relates to an electrical connector assembly, and particularly to a stacked Local Area Network (LAN) connector assembly mountable on a printed circuit board (PCB).

2. Description of Prior Art

Modular jack receptacle connectors and universal serial bus (USB) connectors are well known in the computer industry and are generally provided at input/output ports for transmitting data or signals between an electronic apparatus and printed circuit boards (PCBs). Today such connectors are always stacked to be mounted on the PCBs, named as a LAN connector assembly, for saving space in computers and their costs in manufacture, as is disclosed in U.S. Pat. Nos. 6,162,089 and 5,797,770.

Regarding the modular jack receptacle connector of the LAN connector assembly, it is especially used in communications and data networking equipments. In order to ensure that a proper connection has been made and therefore a link is created between the electrical communication devices, indicators are often incorporated into circuits on the PCBs. These indicators are typically light emitting diodes (LEDs) which are turned on when a circuit is established between the mating connectors and the communication devices. Additionally, LEDs can be mounted on the PCB to indicate a number of other conditions including the passage of communication signals between the two communication devices, indicative of power, or indicative an error in transmitting the signals.

U.S. Pat. No. 4,973,317 and Taiwan Patent. Nos. 404,586 and 389,391 disclosed such modular jack connectors. Particularly referring to FIG. 8, a modular jack receptacle connector 90 disclosed in U.S. Pat. No. 404,586 comprises an insulative housing 91 defining a pair of channels 911, a terminal module 95 to be inserted in the insulative housing 91, a pair of LEDs 93 fitted in the channels 911, a pair of separate covers 94 covered onto respective LEDs 93, and a shell 92 covering onto the insulative housing 91. However, since one cover 94 is only covered to a single LED 93, the assembly therebetween is complicated. Additionally, the cover 94 cannot effectively retain the LED 93 in place due to its limited size or weight.

Hence, a modular jack connector with an improved retaining mechanism for LEDs thereof is required to overcome the disadvantages of the prior art.

BRIEF SUMMARY OF THE INVENTION

A first object of the present invention is to provide a modular jack receptacle connector having a retaining mechanism to effectively retain LEDs thereof in place;

A second object of the present invention is to provide a retaining mechanism for a modular jack receptacle connector, which is easy in manufacture and assembly.

An electrical connector assembly in accordance with the present invention comprises a main dielectric housing defining a first cavity and a second cavity separated from the first cavity, a first shielded connector inserted into the first cavity, and a modular jack connector inserted into the second cavity. The modular jack connector has a dielectric body, a terminal module retained in the dielectric body, a pair of LEDs fitted with the dielectric body, and a single retainer covered onto the LEDs to secure the LEDs in position.

Other objects, advantages and novel features of the invention will become more apparent from the following detailed description of the present embodiment when taken in conjunction with the accompanying drawings.

DETAILED DESCRIPTION OF THE INVENTION

Figure 1:
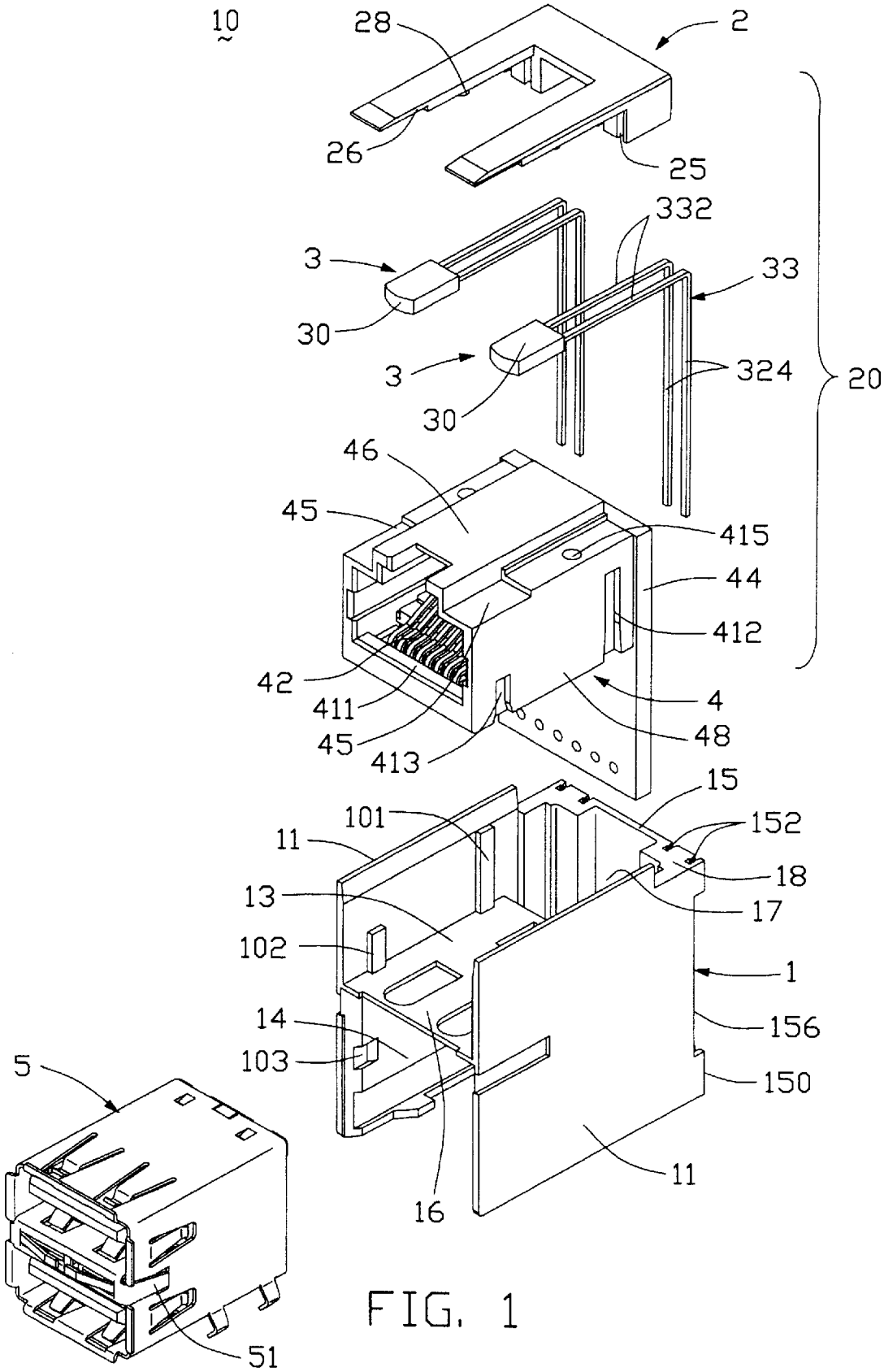
FIG. 1 is an exploded perspective view of an electrical connector assembly in accordance with the present invention.

Reference will now be made to the drawings for more detail, and first referring to FIG. 1, an exploded perspective view of an electrical connector assembly 10 in accordance with the present invention is shown. The electrical connector assembly 10 includes a main housing 1, a shielded USB connector 5 and a modular jack 20 stackably assembled with the main housing 1, around which an outer shield 7 (see in FIG. 8) is covered.

Figure 2:
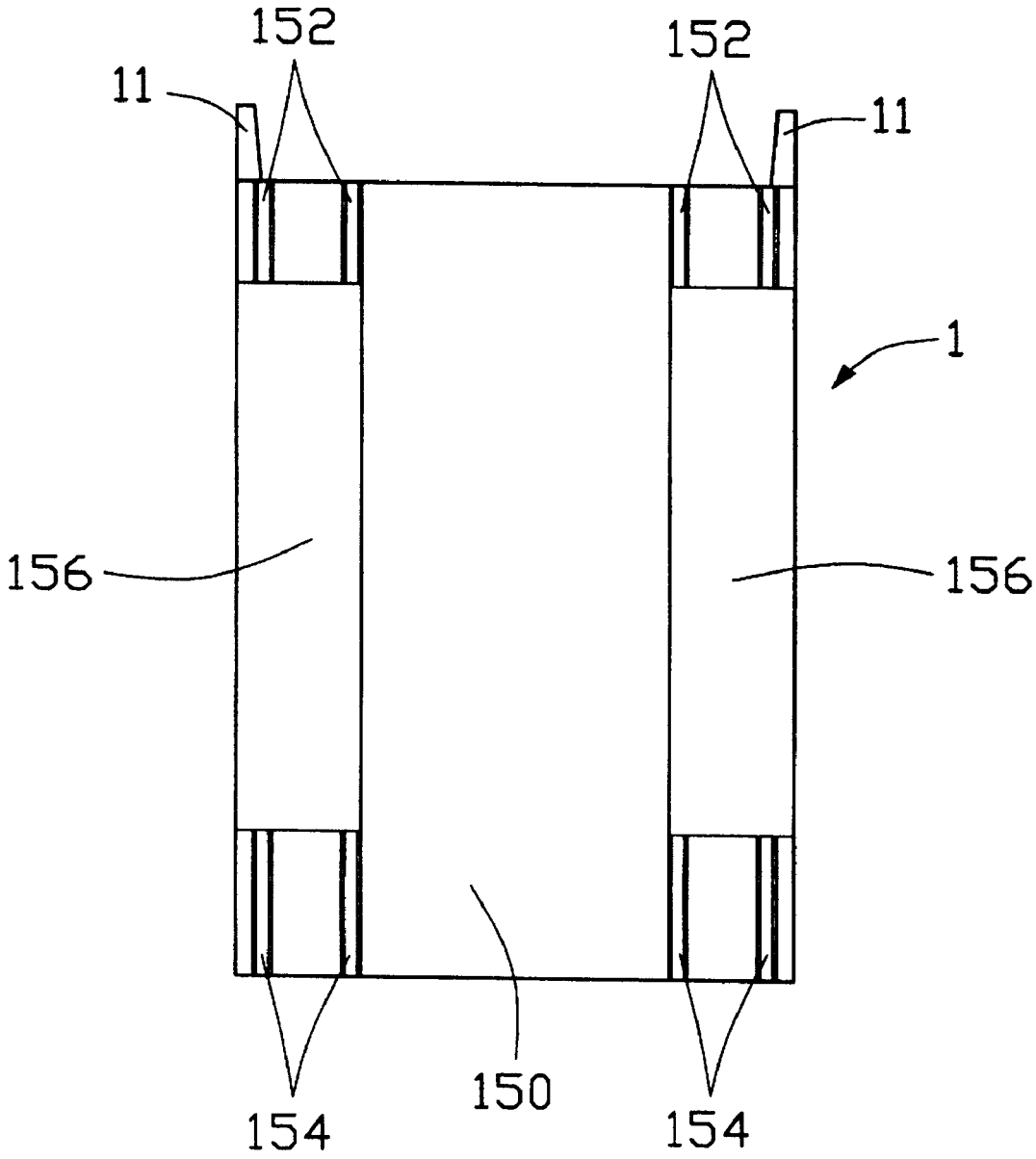
FIG. 2 is a rear view of a main housing of the electrical connector of FIG. 1.

Further referring to FIG. 2, the main housing 1 has a pair of side walls 11, a rear wall 15 and a partition plate 16 connecting with the side walls 11, which cooperatively define a lower receiving cavity 13 and an upper receiving cavity 14 separate from each other. Each side wall 11 forms a recess 103 communicating with the lower receiving cavity 13 and two spaced apart ribs 101, 102 communicating with the upper receiving cavity 14. The rear wall 15 and both side walls 11 cooperatively define a recessed mounting portion 18 therebetween. The partition plate 16 and the rear wall 15 are distanced from each other to define a receiving slot 17 therebetween. The rear wall 15 defines a pair of enlarged cutouts 156 in opposite sides of a rear surface 150 thereof. Additionally, a pair of upper slits 152 and a pair of lower slits 154 aligned with the upper slits 154 are formed in upper and lower sides of each cutout 156, respectively.

The shielded USB connector 5 is adapted for insertion into the lower receiving cavity 14 from the front of the main housing 1 and is to be mounted on an underlying PCB (not shown). The USB connector 5 has a conventional structure and thus detailed description thereof is omitted. It is noted that a pair of spring tabs 51 are formed on opposite sides of the connector 5 to be latched with the recesses 103 of the main housing 1 for retaining the connector 5 in position.

Figure 6:
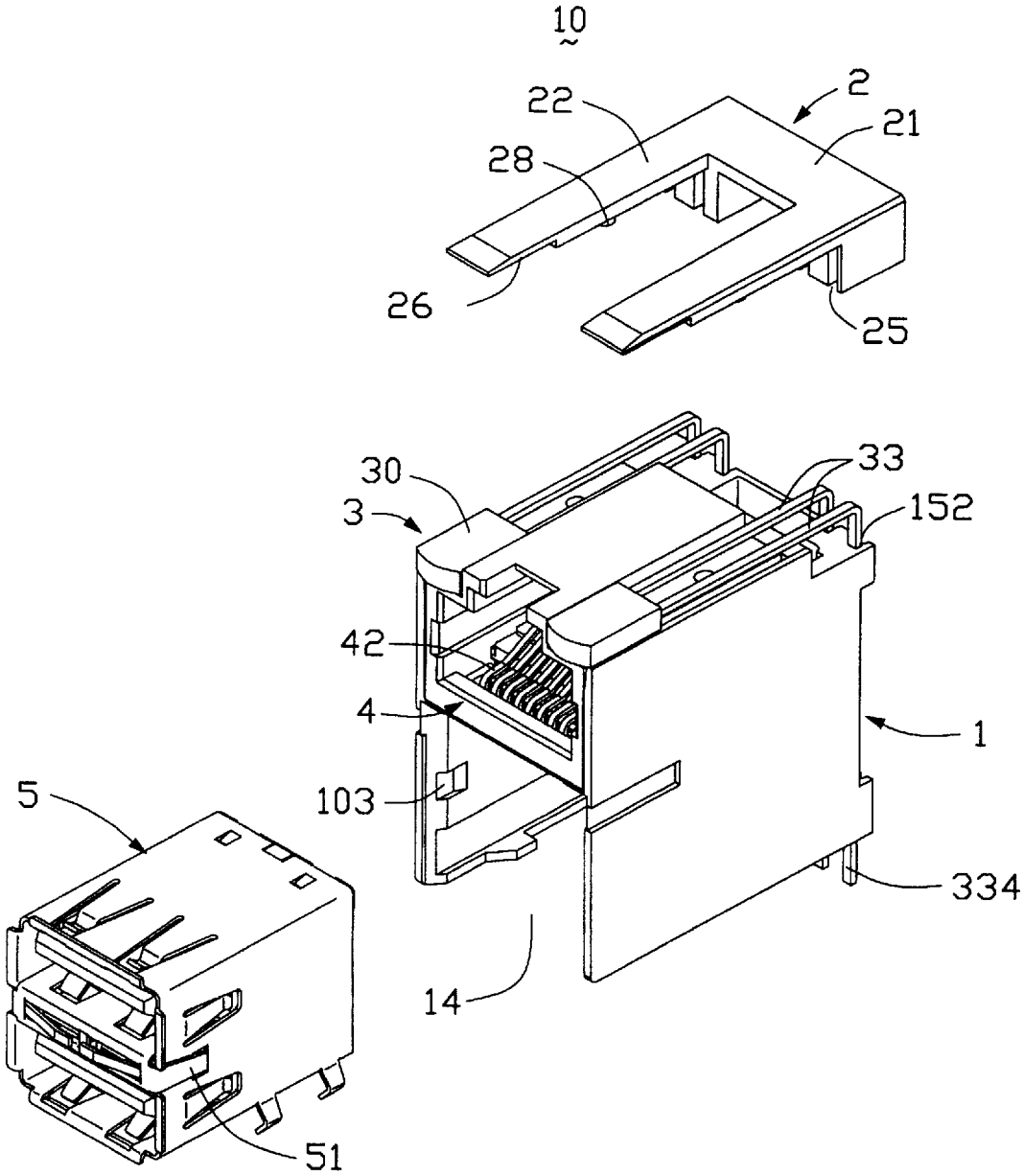
FIG. 6 is a partially assembled view of FIG. 1.
Figure 7:
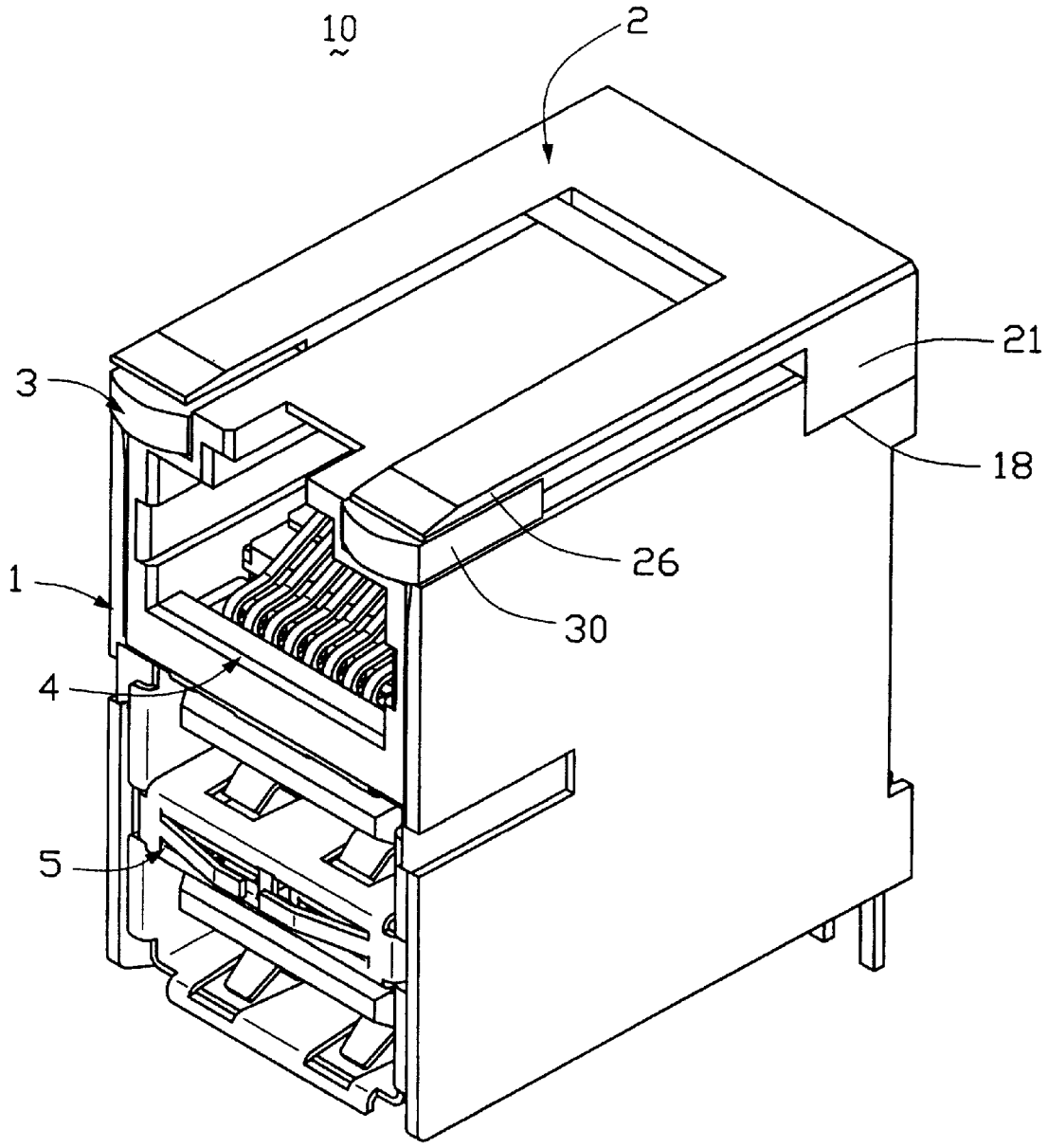
FIG. 7 is an assembled view of FIG. 1.

The modular jack 20 includes a dielectric body 4 with a terminal module 42 retained therein, a pair of LEDs 3 fitted with the electric body 4 and a non-conductive retainer 2 covering the LEDs 3. The dielectric body 4 defines an aperture 411 in a front face thereof for receiving a plug portion (not shown) to mate with the terminal module 42 therein. A transition board 44 is vertically fastened at the rear end of the dielectric body 4 and is electrically connected with the terminal module 42. A pair of slots 45 are defined in opposite sides of the top wall 46 of the dielectric body 4 and each has a hole 415 in a bottom face thereof. Additionally, a pair of rib-receiving slots 412, 413 are defined in each sidewall 48 of the dielectric body 4 for receiving the two ribs 101, 102 of the main housing 1, respectively. The LEDs 3 are received in the slots 45 of the dielectric body 4 and each has an indicator 30, two lead wires 33 extending rearward from the indicator 30. Each lead wire 33 has a horizontal section 332 mounted on a corresponding slot 45 and a vertical section 334 partially retained in an upper slit 152 and a corresponding lower slit 154 of main housing 1, as best seen in FIG. 6.

Figure 3:
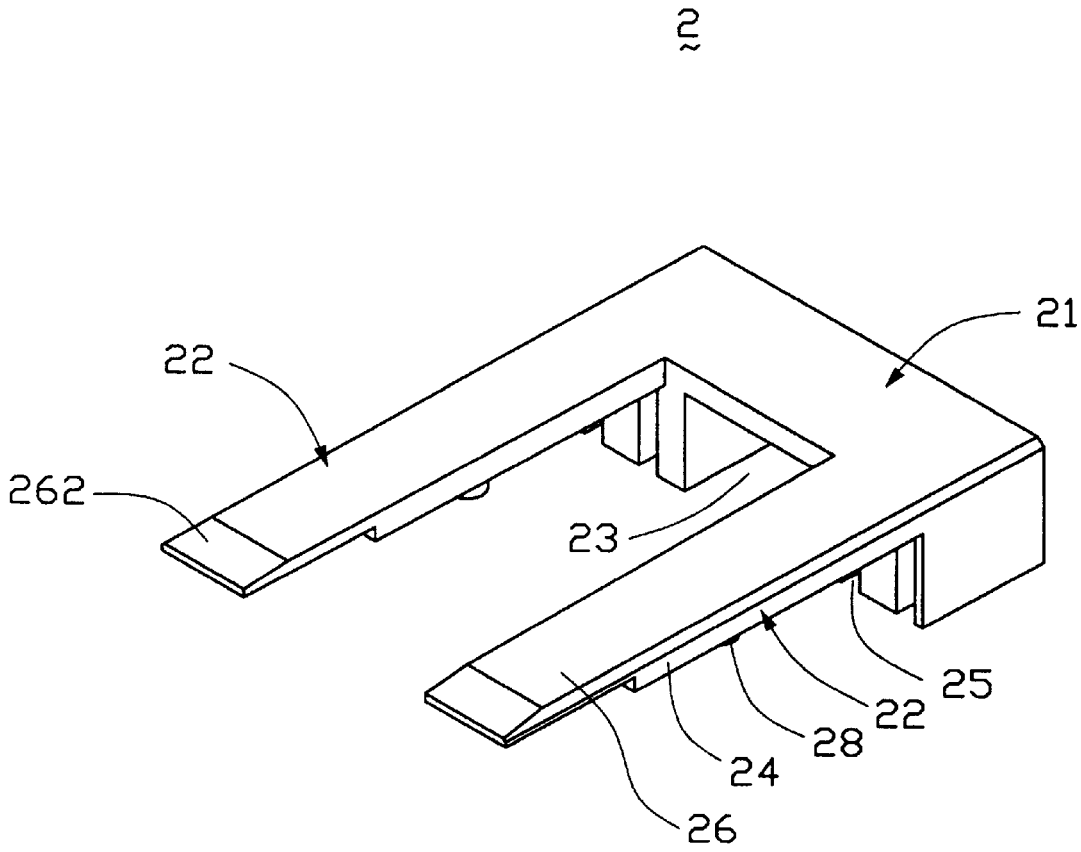
FIG. 3 is a perspective view of a non-conductive retainer of the electrical connector assembly of FIG. 1.
Figure 4:
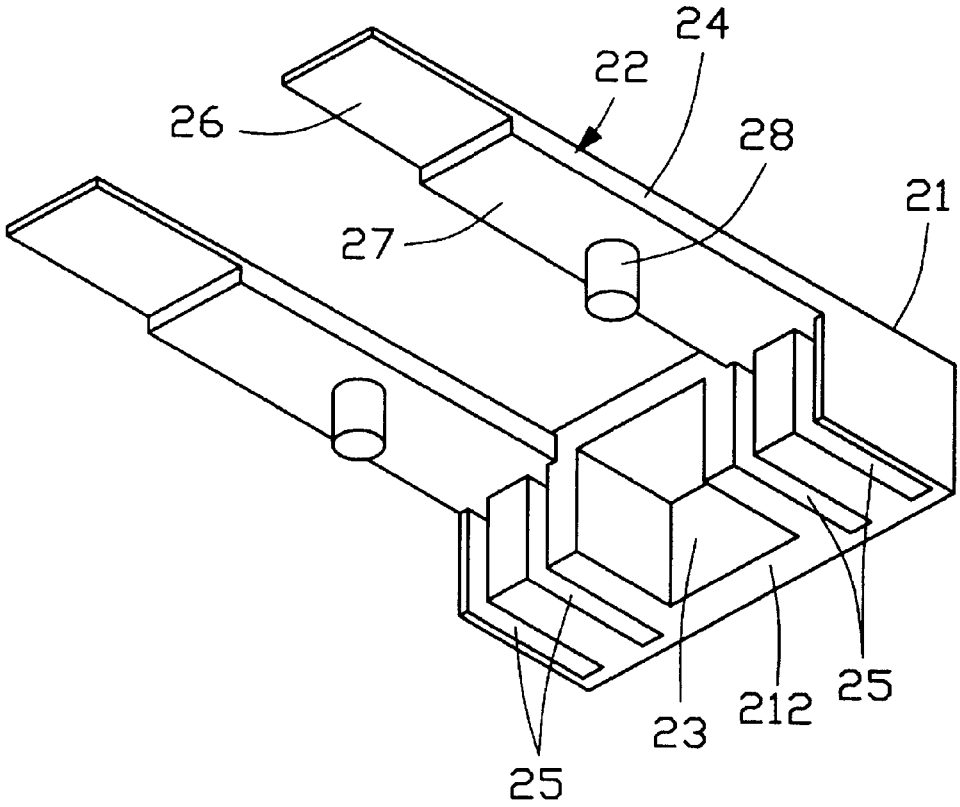
FIG. 4 is another perspective view of FIG. 3.
Figure 5:
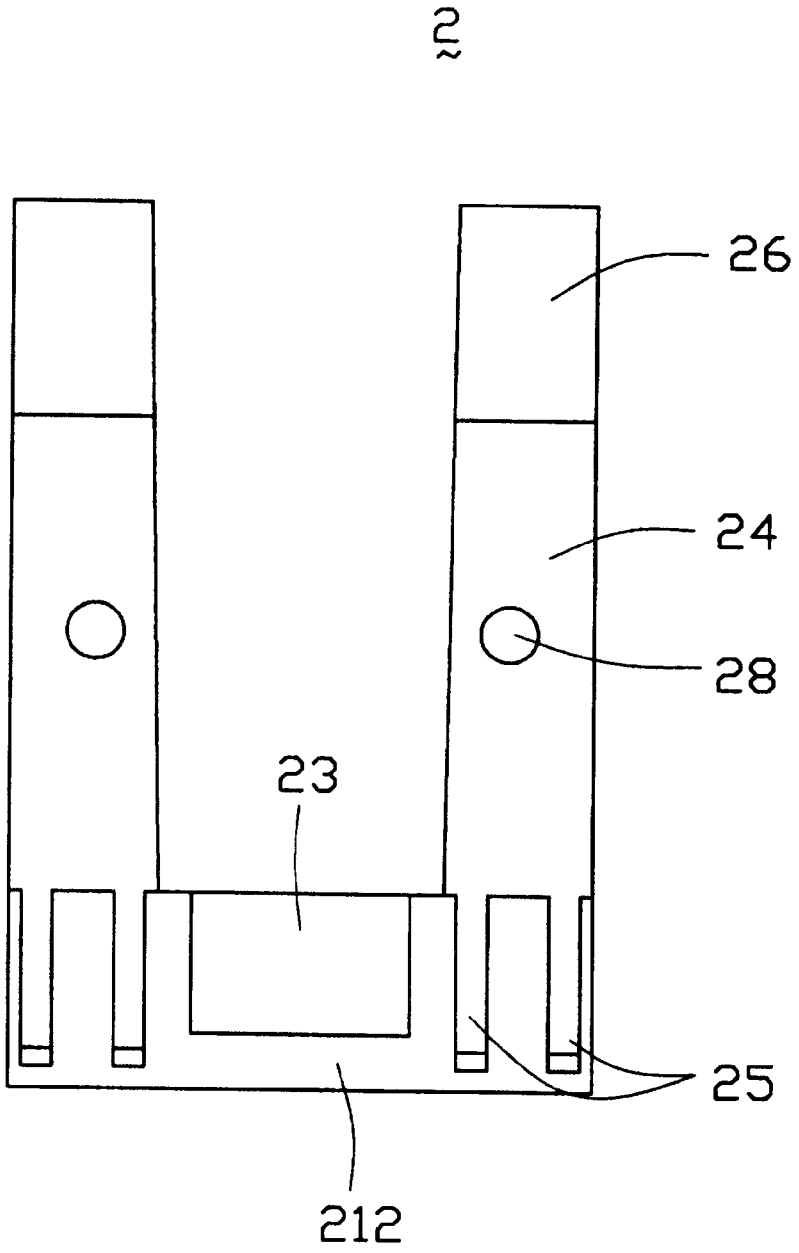
FIG. 5 is a bottom view of FIG. 4.

Further referring to FIGS. 3 to 5, the non-conductive retainer 2 has a body portion 21 and a pair of elongate arms 22 integrally extending forward from the body portion 22. The body portion 21 defines in a bottom face 212 thereof a central recess 23 and two pairs of side slots 25 beside the central recess 23. Each elongate arm 22 has a thick body 24 and a thin sheet 26 extending forward from the thick body 24. The thick body 24 forms a post 28 depending downward from a bottom surface 27 thereof to be inserted into a corresponding hole 415 of the dielectric body 4. The thin sheet 26 has an inclined surface to form a tapered end 262.

Figure 8:
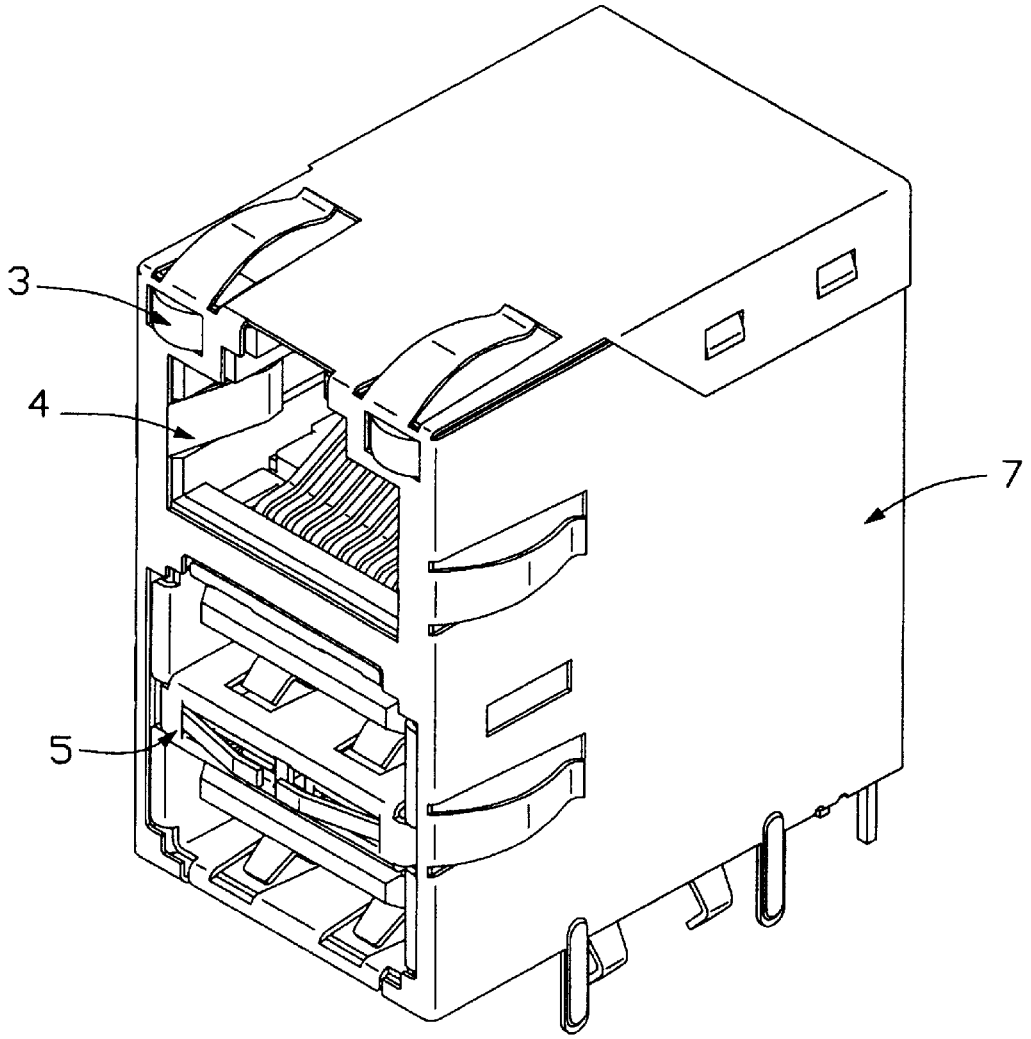
FIG. 8 is an assembled view of FIG. 7 with a shield.
Figure 9:
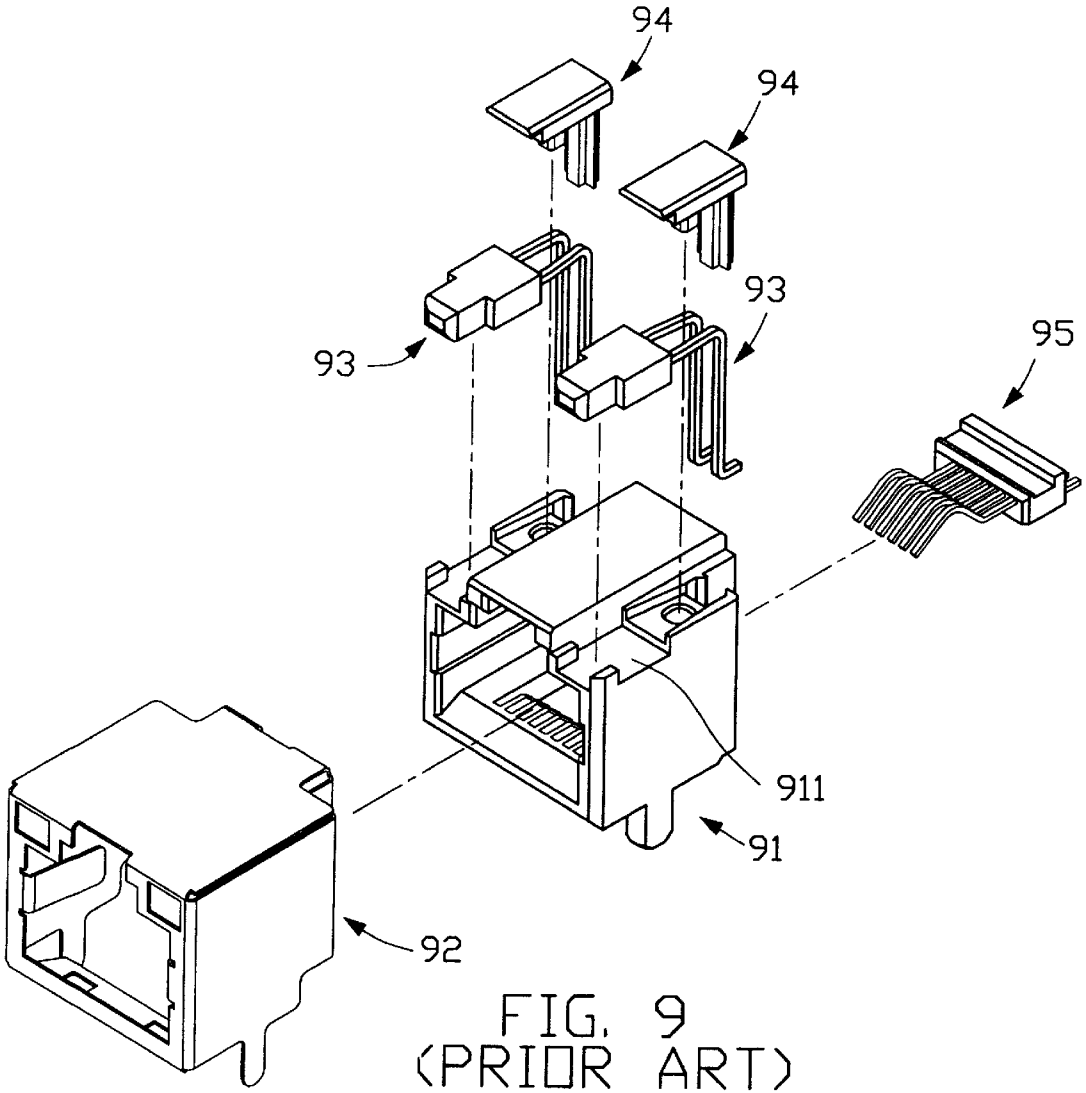
FIG. 9 (PRIOR ART)
FIG. 9 is an exploded perspective view of a prior art electrical connector.

In assembly, referring to FIGS. 1 and 6–8, the USB connector 5 is inserted into the lower receiving cavity 14 from the front of the main housing 1 and the spring tabs 51 thereof are latched with corresponding recesses 103 of the housing 1. The dielectric body 4 combined with the transition board 44 of the modular jack 20 is inserted into the upper receiving cavity 13 from the above of the main housing 1, and the transition board 44 is received in the receiving slot 17. The LEDs 3 are placed into corresponding slots 45 of the dielectric body 4 and the vertical sections 334 of the lead wires 33 thereof are partially retained by corresponding upper and lower slits 152, 154 of the main housing 1. The non-conductive retainer 2 is then covered onto the pair of LEDs 3, and the body portion 21 thereof is mounted onto the recessed mounting portion 18 of the main housing 1. The thick body 24 and the thin sheet 24 of each elongate arm 22 are covered on the horizontal sections 332 of the lead wires and the indicator 30 of a corresponding LED 3, respectively. Additionally, the partial horizontal sections 332 of the lead wires 33 are retained into corresponding side slots 25 of the body portion 21, and the posts 28 of the retainer 2 are inserted into corresponding holes 415 of the dielectric body 4. Using this arrangement, the single non-conductive retainer 2 can securely retain the pair of LEDs 3 in place simultaneously, and the LEDs 3 will not move or offset under variation conductions. Furthermore, the non-conductive retainer 2 is easy to manufacture and assemble, thereby saving the manufacture cost with respect to the prior art. At last, the outer shield 7 is covered on the combination elements shown in FIG. 7, as is seen in FIG. 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a main dielectric housing defining a first cavity and a second cavity separated from the first cavity;

a first shielded connector being inserted into the first cavity; and a modular jack connector being inserted into the second cavity and having a dielectric body, a plurality of terminals retained in the dielectric body, a pair of light emitting diodes (LEDs) fitted with the dielectric body, and a single retainer covered onto the LEDs and secure the LEDs to the dielectric body;

wherein the single retainer is made of plastic material and has a body portion and a pair of arms extending from the body portion;

wherein each LED has an indicator and two lead wires extending from the indicator, each lead wire having a horizontal section and a vertical section depending from the horizontal section, and wherein each arm has a first retaining portion covering the horizontal section of the lead wire and a second retaining portion extending forwardly from the first retaining portion to cover the indicator;

wherein the dielectric body defines in a rear wall thereof an upper slit and a lower slit aligned with the upper slit to retain the vertical section of the lead wire;

wherein the dielectric body defines a hole in a top wall thereof and wherein the arm defines a post depending downwardly from a bottom face thereof to be retained in the hole;

wherein the body portion defines in a bottom face thereof a central recess and a pair of slots at each side of the central slot for partially receiving the horizontal sections of the lead wires of a corresponding LED;

wherein the first retaining portion of the arm forms a tapered end.

* * * * *